United States Patent [19]

Kobayashi et al.

[11] Patent Number: 4,624,631

[45] Date of Patent: Nov. 25, 1986

[54] METHOD AND APPARATUS FOR GASIFYING AND COMBUSTING LIQUID FUEL

[75] Inventors: Hiroshi Kobayashi; Mikio Sawai; Junji Mieda, all of Shiga; Seiichi Yoshikubo, Kitakyushu, all of Japan

[73] Assignee: Toto Ltd., Kitakyushu, Japan

[21] Appl. No.: 721,711

[22] Filed: Apr. 10, 1985

[30] Foreign Application Priority Data

Apr. 19, 1984 [JP] Japan ..... 59-79728
Oct. 13, 1984 [JP] Japan ..... 59-214483

[51] Int. Cl.[4] ..... F23M 3/00

[52] U.S. Cl. ..... 431/9; 431/116; 431/265; 431/350

[58] Field of Search ..... 431/9, 115, 116, 265, 431/350

[56] References Cited

U.S. PATENT DOCUMENTS 3,460,895 8/1969 Yamaguchi ..... 431/116
3,927,958 12/1975 Quinn ..... 431/116
4,004,875 1/1977 Zink et al. ..... 431/9
4,473,349 9/1984 Kumatsu ..... 431/116

*Primary Examiner*—Carroll B. Dority, Jr.

*Attorney, Agent, or Firm*—Oblon, Fisher, Spivak, McClelland & Maier

[57] ABSTRACT

An apparatus for gasifying and combusting a liquid fuel, comprising: a fuel spraying nozzle; an air blowing cylinder disposed coaxially with and so as to surround the fuel spraying nozzle; a porous burner cone made of an absorptive porous ceramic, consisting of a practically cylindrical section and a conical section merging into the practically cylindrical section and expanding toward the front, and disposed in front of the air blowing cylinder coaxially with the fuel spraying nozzle; a burner cup of the shape of a hollow cone provided with a suitable number of small holes formed in the wall thereof over the entire area except the central portion thereof around the apex and disposed with the majority thereof received in the conical section of the porous burner cone so that the space formed between the porous burner cone and the burner cup has an appropriate cross-sectional area to prevent the stagnation of the air-fuel mixture within the porous burner cone and to make the air-fuel mixture flow through the space at a flow speed higher than the flaming speed; and a flame holding ring disposed in front of the burner cup for forming stable blue flames. The combustion gas is circulated through the porous burner cone to gasify the fuel droplets sprayed by the fuel spraying nozzle.

4 Claims, 10 Drawing Figures

METHOD AND APPARATUS FOR GASIFYING AND COMBUSTING LIQUID FUEL

BACKGROUND OF THE INVENTION

1. Field of the Invention

The present invention relates to a method and an apparatus for gasifying and combusting a liquid fuel.

2. Description of the Prior Art

The combustion modes of kerosene are classified generally into a blue flame combustion mode and a white flame combustion mode. A premixed flame containing sufficient oxygen is a blue flame and a diffusive flame is a white flame (luminous flame). The kerosene combusting process is supposed to be as represented by the flow chart of FIG. 4. As is apparent from FIG. 4, the mode of combustion is dependent on the mode of diffusion of oxygen. Factors that affect the diffusion of oxygen are:

1. quantity of air (oxygen) supplied for combustion,
2. mass of the fuel, and
3. the turbulence of the flow of air-fuel mixture.

Blue flame combustion requires sufficient air for combustion, well atomized fuel particles of small mass (complete atomization of the fuel into fine droplets), or a turbulent flow of the air-fuel mixture for completely mixing the fuel and air.

With the conventional gun type burner which is widely used for combusting kerosene, it is difficult to achieve blue flame combustion even if the above-mentioned requirements of blue flame combustion are met. Such difficulty is attributable to the construction of the conventional gun type burner and the resultant mode of combustion. In the conventional gun type burner, a flame holding member is disposed right behind a fuel spraying nozzle, and thereby a stable flame which serves as an ignition source for igniting the successively sprayed fuel is formed in the flame holding member. Therefore, the actions in all the stages of the combustion process shown in FIG. 4 occur simultaneously, and hence each fuel droplet is ignited over the surface thereof before it is gasified, and each fuel droplet then burns in a diffusive flame ball consisting of a central core of the liquid fuel and a flame shell concentrically surrounding the central core of the liquid fuel. This mode of combustion causes unsatisfactory diffusion of oxygen and results in white flame combustion instead of blue flame combustion.

In white flame combustion (diffusive combustion), oxygen needs to diffuse into the fuel droplet through the flame of the diffusive flame ball and mixing the fuel and air needs to be accelerated by the turbulent flow of air or by supplying excessive air. Accordingly, a white flame burner needs to be equipped with means to generate a turbulent air flow (for example, a maximum impulse flow) and means to supply excessive air.

In the white flame combustion, carbon is oxidized in the colloidal state, and, if oxygen is not diffused satisfactorily, carbon is discharged in the form of soot. Such unsatisfactory diffusion of oxygen is possible due to local irregular mixing of the fuel and air even if sufficient oxygen is supplied.

Furthermore, unsatisfactory diffusion of oxygen causes the production of intermediate gaseous products of oxidation (in most cases, carbon monoxide).

The amount of those products of combustion contained in the exhaust gas increases remarkably when the excessive air ratio is reduced. Accordingly, in the diffusive combustion, it has been difficult to reduce the excess air ratio below a certain level.

In the white flame combustion, it is necessary to generate a turbulent flow to accelerate air-fuel mixing. However, the turbulent flow includes diffusive flame balls which are burning and generates loud noises. Thus, the turbulent flow has been the principal causes of combustion noise. It has also been a problem in the white flame combustion that, if the magnitude of the turbulence of the flow is enhanced to achieve complete combustion, the combustion noise increases proportionally. Furthermore, it is usual to form a narrow passage behind the flame holding member to generate the turbulent flow, which raises the level of combustion noise still further because the flame is formed in a narrow space having an opening.

In the blue flame combustion, since oxygen diffuses easily into the evaporated gasiform fuel, an intensive turbulent flow and excessive air are not necessary.

Accordingly, in the blue flame combustion, the excess air ratio can be reduced near to the stoichiometric mixture ratio.

In the blue flame, a smaller amount of colloidal carbon is produced, the gasiform fuel and oxygen are diffused and mixed satisfactorily, the production of soot and carbon monoxide is reduced, and nearly complete combustion is achieved even if the excess air ratio is small.

Accordingly, in the blue flame combustion, the excess air ratio can be reduced near to the stoichiometric mixture ratio, and the flame temperature rises near to the adiabatic flame temperature since the fuel and air are mixed well and the combustion zone is narrowed.

Furthermore, since the blue flame combustion occurs after the fuel and air have been completely mixed and the flame is formed near the open end of the flame holding member, only low combustion noise is generated.

It is obvious from what has been described hereinbefore that the blue flame combustion is superior to the white flame combustion in burning a liquid fuel in gas phase.

Few improvements in the combustion process employing a liquid fuel gasification burner of this kind have been made on the basis of the principle of combustion so far, and the most of those improvements have been partial improvements in the components of the burner.

The prior arts disclosed in Japanese Patent Publication No. Sho 39-21913, Japanese Utility Model Publication No. Sho 57-32341 and Japanese Patent Laid-open No. Sho 55-41393, which are considered to be closely connected with the present invention, employed a porous ceramic burner cone in the combustion zone. However, those prior arts are not based on the fundamental principle of combustion, and the effective use of heat, such as the circulation of the combustion gas, is not taken into consideration. According to the invention disclosed in Japanese Patent Laid-open No. Sho 55-41393, since a flame holding member is disposed right in front of a nozzle, fuel droplets are ignited in the flame holding member before they are gasified completely, and hence perfect blue flame combustion is impossible.

Japanese Patent Laid-open No. Sho 58-200911 discloses a gun type burner equipped with a porous or net-form flame holding plate and adapted to utilize combustion gas circulating process. However, since the combustion gas flowing in a circumferential direction along the wall of the furnace is circulated, the gasification of the fuel in the initial stage of combustion is delayed, which lowers the ignitability of the fuel. Furthermore, since the jet of the air-fuel mixture is directed at the flame holding plate, the fuel droplets are ignited upon their collision against the flame holding plate and start burning before they are gasified completely. Accordingly, white flame combustion occurs, and perfect blue flame combustion is impossible, which reduces the thermal efficiency.

OBJECT OF THE INVENTION

Accordingly, it is an object of the present invention to provide a method and an apparatus for gasifying and combusting a liquid fuel free of the disadvantages of the conventional burner and employing a liquid fuel gasifying burner (particularly one of 23,000 to 57,000 kcal/hr combustion capacity) capable of achieving perfect blue flame combustion.

SUMMARY OF THE INVENTION

According to the present invention, to achieve perfect blue flame combustion, the diffusion of oxygen (Namely, air-fuel mixing) is accelerated, and a nozzle zone, a combustion air flow zone, a fuel gasifying zone, a mixing zone, a combustion zone, and a high-temperature gas circulating zone are formed separately. Furthermore, if necessary, a whirling air flow is formed in the combustion air flow zone to accelrate air-fuel mixing in the mixing zone and to distribute air uniformly.

Other objects, features and advantages of the present invention will become apparent from the description of preferred embodiments thereof taken in connection with the accompanying drawings.

BRIEF DESCRIPTION OF THE DRAWINGS p

DESCRIPTION OF THE PREFERRED EMBODIMENTS

Figure 1:
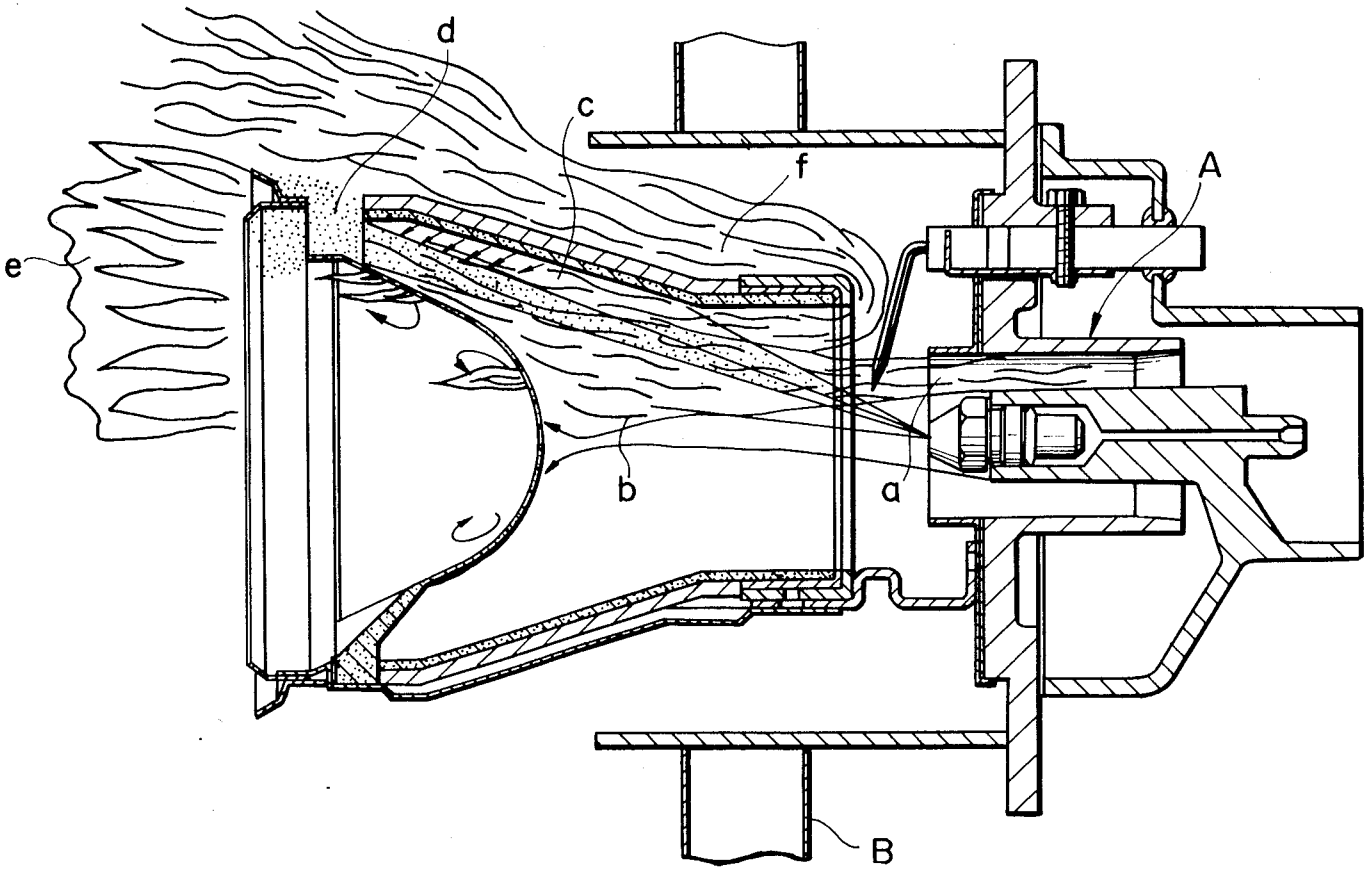
FIG. 1 is a schematic sectional view of a burner, for explaining the first principle of the present invention.
Figure 2:
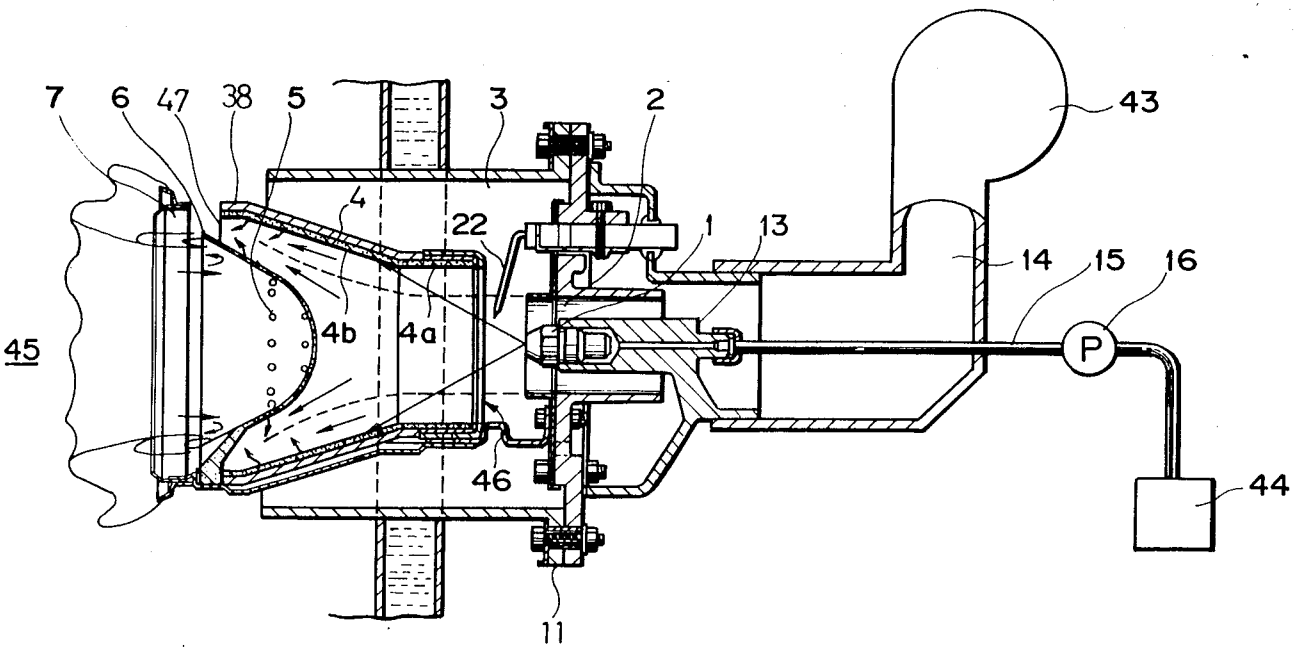
FIG. 2 is a sectional view of the essential part of a hot water supplying apparatus equipped with a burner, in a first embodiment, according to the present invention.
Figure 3:
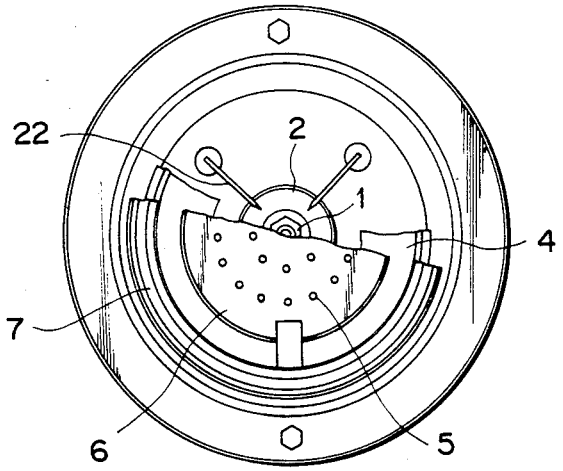
FIG. 3 is a front elevation partly broken of the burner of FIG. 2.
Figure 4:
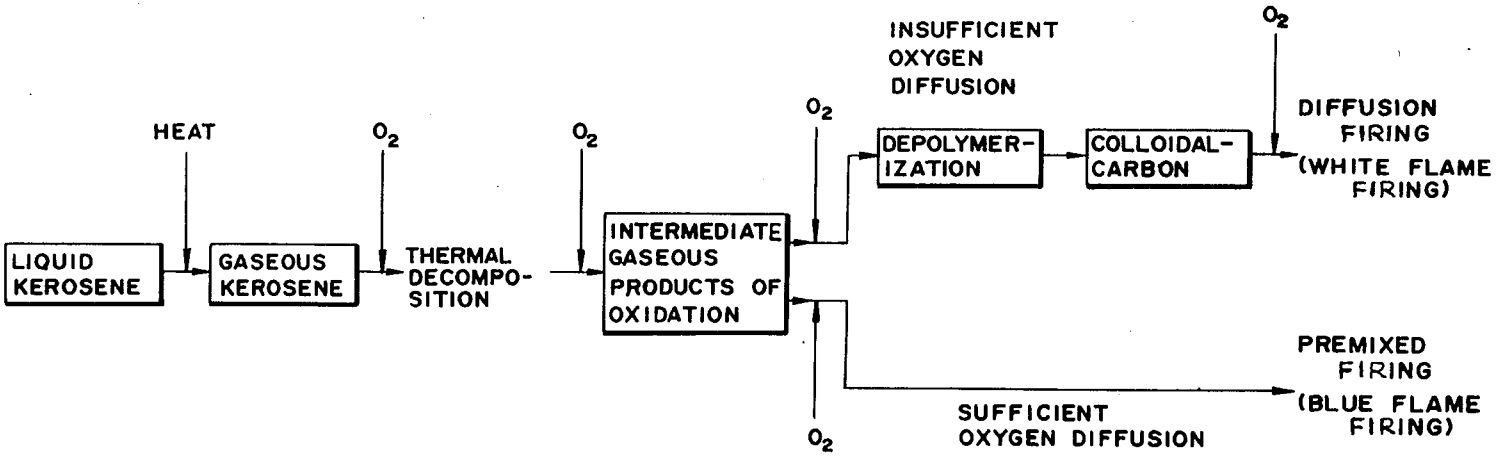
FIG. 4 is a flow chart of the combustion process of kerosene.

The principle of the present invention will be described in connection with FIGS. 1 and 2. A nozzle zone (a), a combustion air flow zone (b), a fuel gasifying zone (c), a mixing zone (d), a combustion zone (e), and a high-temperature combustion gas circulating zone (f) are formed completely separately. The liquid fuel sprayed by a fuel spraying nozzle 1 flows through the combustion air flow zone (b) in atomized droplets without being ignited. The droplets of the fuel are gasified in the fuel gasifying zone (c) by the heat of the high temperature combustion gas sucked through the high-temperature combustion gas circulating zone (f) into the fuel gasifying zone (c). The gasified fuel is mixed with air in the mixing zone (d), and then the mixture of the fuel and air is ignited in the combustion zone (e).

To form the nozzle zone (a), the combustion air flow zone (b), the fuel gasifying zone (c), the mixing zone (d), the combustion zone (e), and the high-temperature combustion gas circulating zone (f) separately, the fuel should not be mixed with air and ignited in the fuel gasifying zone (c), and the air-fuel mixture should not be ignited in the mixing zone (d). These requisite conditions are satisfied by a fuel gasifying and combusting apparatus of a constitution as described hereunder.

The nozzle zone (a) accomodates the fuel spraying nozzle 1 held by a nozzle holder 13 so as to spray the fuel into the combustion chamber 45 and an air blowing cylinder 2 surrounding the fuel spraying nozzle 1 and disposed coaxially with the fuel spraying nozzle 1. A porous burner cone 4 made of a porous ceramic of 20 to 50% porosity and having a cylindrical section 4*a* and a conical section 4*b* formed continuously and a combustion gas inlet 46 is disposed coaxially with the fuel spraying nozzle 1 with the combustion gas inlet 46 disposed adjacently to the air blowing cylinder 2 so as to surround the fuel spraying zone. A hollow conical or semispherical porous burner cup 6 made, similarly to the burner cone 4, of a porous ceramic and having an open bottom and small holes 5 formed over the surface thereof is disposed behind the burner cone 4 with its convex wall protruded into the outlet opening of the porous burner cone 4 and coaxially with the porous burner cone 4. An igniter 22 is disposed downstream of the air blowing cylinder 2.

An annular flame holding ring 7 of a V- or U-shaped cross section is disposed in front of the burner cup 6 coaxially with the burner cup 6.

In the case of a burner A of 23,000 to 57,000 kcal/hr combustion capacity, the dimensions and layout of those components are decided to satisfy the following conditions.

The fuel spraying nozzle 1 sprays the fuel at a spraying angle of 60° in the spraying pattern of a hollow cone and the outside diameter of the nozzle holder 13 is 21 mm;

the speed of air blown through the air blowing cylinder 2 is 10 to 19 m/sec;

the sectional area of the air blowing cylinder 2 is 0.00077 to 0.00146 $m^2$;

the inside diameter of the air blowing cylinder 2 is 37 to 48 mm;

the ratio of the inside diameter of the cylindrical section of the porous burner cone 4 to the inside diameter of the air blowing cylinder 2 is 1.3 or above;

the ratio of the inside diameter to the length of the air blowing cylinder 2 is 1:2;

the length of the air blowing cylinder 2 is 20 mm or above;

(the sectional area of the air blowing cylinder 2)/{(the sectional area of the cylindrical section 4*a* of the porous burner cone 4)−(the sectional area of the air blowing cylinder 2)}<1;

the difference between the sectional area of the cylindrical section 4a of the porous burner cone 4 and the sectional area of the air blowing cylinder 2 is 0.00077 $m^2$ or above;

the inside diameter of the cylindrical section 4a of the porous burner cone 4 is 48 mm or above;

(the gap area defined by the oulet of the porous burner cone 4 and the burner cup 6)/{the section area of the air outlet of the air blowing cylinder 2+(the sectional area of the cylindrical section 4a of the porous burner cone 4−the sectional area of the air blowing cylinder 2)}>1;

the gap area is 0.00154 to 0.00667 $m^2$; and the angle of expansion of the conical section 4b of the porous burner cone 4 is 30°.

In operation, the fuel is sprayed by the fuel spraying nozzle 1 at an injection rate of 2.5 to 7.0 l/hr, and air is blown through the air blowing cylinder 2 at an air supply rate of 0.5 to 1.3 $Nm^3$/min so that 40% of the total fuel sprayed by the fuel spraying nozzle 1 reaches the porous burner cone 4 or the porous burner cup 6. Consequently, the air supplied flows through the central area of the porous burner cone 4 in the combustion air flow zone (b), and the combustion gas containing insufficient oxygen is sucked into the interior of the porous burner cone 4 by the agency of the air current flowing at a high velocity along the center axis of the porous burner cone 4 and flows along the wall surface of the porous burner cone 4 in the fuel gasifying zone (c). The gassiform fuel gasified by the heat of the porous burner cone 4 also flows along the wall surface of the porous burner cone 4. According to the present invention, the relation between the air blowing cylinder 2 and the cylindrical section 4a of the porous burner cone 4 in diameter and the form of the porous burner cone 4 are designed so that those two flows of gases each of non-inflammable composition (namely) the flow of the combustion gas containing insufficient oxygen and the flow of the gasified fuel) are not mixed in the fuel gasifying zone (c). In the mixing zone (d), the area of the annular space formed between the outlet opening of the porous burner cone 4 and the burner cup 6 is designed so that the flaming speed and the flow rate of the air-fuel mixture are balanced in the mixing zone (d) to prevent flash back.

In the combustion process according to the present invention, the suction of the combustion gas into the porous burner cone 4 is essential to achieve blue flame combustion. The forms and dimensions of the components of the burner are designed so that the combustion gas is sucked into the interior of the porous burner cone 4 at an appropriate rate.

If the diameter of the air blowing cylinder 2 is too small, the air blowing speed becomes excessively high, and the air collides against the burner cup 6 and generates a back pressure. This impedes the suction of the combustion gas into the interior of the porous burner cone 4 and enhances the combustion noise. On the other hand, if the diameter of the air blowing cylinder is too large, the velocity of the air diminishes excessively, which also affects adversely the suction of the combustion gas. Accordingly, the desirable diameter of the air blowing cylinder and the blowing velocity are 37 to 48 mm and 10 to 19 m/sec respectively.

If the air blowing cylinder 2 is too short, the air blown by the air blowing cylinder 2 is unable to introduce the sparks of the igniter 22 into the fuel spraying zone along the center axis of the burner, which causes misfire or orange flame burning within the porous burner cone 4 due to the mixing of the combustion gas and air within the porous burner cone 4 and increases the combustion noise.

Accordingly, it is desirable that the length of the air blowing cylinder 2 is approximately half or more of the diameter of the air blowing cylinder 2 and is 20 mm or more.

The diameter of the air blowing cylinder 2 and the diameter of the cylindrical section of the porous burner cone 4 also influence the condition of combustion. If the difference between those diameters decreases (for example, if the diameter of the cylindrical section 4a of the porous burner cone 4 is reduced), the gasiform fuel gasified by the combustion gas sucked into the porous burner cone 4 and the air are mixed in the rear half section (namely, a section near the fuel spraying nozzle 1) of the porous burner cone 4 and flaming starts within the porous burner cone 4. Accordingly, the diameter of the cylindrical section 4a of the porous burner cone 4 needs to be 1.3 times or above that of the air blowing cylinder.

In order to achieve the appropriate suction of the combustion gas into the porous burner cone 4, it is desirable that (the sectional area of the air blowing cylinder 2)/{(the sectional area of the cylindrical section 4a of the porous burner cone 4)−(the sectional area of the air blowing cylinder 2)}<1, and the difference between the sectional area of the cylindrical section 4a of the porous burner cone 4 and the sectional area of the air blowing cylinder 2 needs to be 0.00077 $m^2$ or above. The desirable inside diameter of the cylindrical section 4a of the porous burner cone 4 is 48 mm or above.

When those above-mentioned conditions are satisfied, the air blown into the porous burner cone 4 flows through the central portion, the gasiform fuel flows outside of the flow of the gasiform fuel, and the air and the gasiform fuel are mixed together in a restricted section 47 defined by the outlet of the porous burner cone 4 and the burner 6. If this is accomplished, a stable flame is formed in the combustion zone (e) formed by the burner cup 6 and the annular flame holding ring 7.

Further description of factors dominating the form and the size of the components of the burner will be made hereinafter.

The suction of the combustion gas into the porous burner cone 4 can be confirmed by measuring the temperature of the gas at the combustion gas inlet 46 (namely, the rear end of the porous burner cone 4) when the combustion gas inlet 46 is open and when the same is closed during combustion in the combustion chamber 45.

During the operation of the burner A embodying the present invention, the temperature of the gas was measured at the combustion gas inlet 46. The measured temperature of the gas was approximately 800° C. when the combustion gas inlet 46 was open and approximately 400° C. when it was closed. This indicates, though indirectly, that the combustion gas is circulated through the combustion gas inlet 46 formed between the air blowing cylinder 2 and the porous burner cone 4.

The flow rate of the combustion gas sucked into the porous burner cone 4 is estimated on the basis of Von Karman's theory of thrust increase. As mentioned above, according to the temperature measurement performed with a practical burner embodying the present invention, the temperature of the gas sucked into the porous burner cone 4 was approximately 800° C. when the combustion gas inlet 46 was open and approximately 400° C. when it was closed. Therefore, the flow rate may be calculated on the assumptions that the sucked gas and the combustion gas are the same in composition and that the temperature of the sucked gas is 800° C.

(1) The resistance term is neglected:

According to the Von Karman's theory of thrust increase, the formula includes a resistance term Ff; however, the resistance term Ff is neglected for calculation. The result of calculation showed that the the ratio n of the flow rate of the gas to that of the combustion air is approximately 1 ($n \approx 1$). That is, the combustion gas is sucked into the porous burner cone 4 at practically the same flow rate as the combustion air.

The maximum quantity of heat brought into the porous burner cone by the combustion gas is approximately 15,000 kcal/hr.

(2) The resistance term is considered:

In the practical burner, the rough surfaces of the porous ceramic burner cone 4 and the ceramic burner cup 6 and the forms of the porous burner cone 4 and the burner cup 6 offer resistance to the flow of the circulated combustion gas and the combustion air, and hence the resistance term Ff is not negligible. If the resistance term Ff is large, the combustion gas can not be sucked into the porous burner cone 4. If this happens, blue flame combustion becomes impossible.

Therefore, according to the present invention, the porous burner cone 4 and the burner cup 6 are designed as described hereinbefore so that the resistance to the flow of the circulated combustion gas is reduced.

(3) According to the present invention, the forms, dimensions and resistance to the flow of the circulated combustion gas of the components of the burner are set to provide an optimum combustion gas suction rate for supplying heat of fuel gasification and preventing flaming within the porous burner cone 4.

When the fuel spraying nozzle 1, the porous burner cone 4, and the burner cup 6 are disposed normally, a part of the fuel sprayed by the fuel spraying nozzle 1 flows through the annular space formed between the porous burner cone 4 and the burner cup 6 without coming into contact with the surfaces of the ceramic members. Supposing that the fuel spraying angle of the fuel spraying nozzle 1 is 60°, the calculated amount of the fuel that contacts the porous burner cone 4 or the burner cup 6 is 81% of the total fuel sprayed.

However, in practice, the actual fuel spraying angle will not be the same as the nominal fuel spraying angle due to the influence of the air flow around the fuel spraying nozzle 1 and the resistance of air. Accordingly the actual amount of the fuel that contacts the porous burner cone 4 or the burner cup 6 will be different from the amount calculated on the basis of the injection pattern of the fuel spraying nozzle 1.

The fuel actually sprayed against the ceramic surfaces of the porous burner cone 4 and the burner cup 6 was collected and weighed. The measure amount was 60% of the total fuel sprayed.

During combustion, no fuel droplet flowing through the porous burner cone 4, flames within the porous burner cone 4 and most of the fuel directed toward the porous burner cone 4 or the burner cup 6 (in this embodiment, 60% of the total fuel sprayed) reaches the porous burner cone 4 or the burner cup 6. Accordingly, approximately 60% of the total liquid fuel sprayed by the fuel spraying nozzle 1 reaches the surface of the porous burner cone 4 or the surface of the burner cup 6. These surfaces are heated by the high-temperature combustion gas sucked through the combustion gas inlet 46 into the porous burner cone 4, then absorbed temporarily by the porous burner cone 4 and the burner cup 6, and then gasified by the heat of the porous burner cone 4 and the burner cup 6 to be changed into primary gasiform fuel.

The fine fuel droplets that cannot reach the porous burner cone 4 or the burner cup 6 are gasified in the fuel gasifying zone (c) by the heat of the circulated high-temperature combustion gas to be changed into secondary gasiform fuel. Mixture of the gasiform fuel and the circulated high-temperature combustion gas sucked through the high-temperature combustion gas circulating zone (f) flows along the inner surface of the porous burner cone 4. While the mixture is flowing along the inner surface of the porous burner cone 4, the concentration of oxygen in the mixture is below the lower limit of combustion. That is, a layer of combustible mixture deficient of oxygen is formed over the inner surface of the porous burner cone 4, which prevents flaming in the fuel gasifying zone (c).

On the other hand, the central portion of the space within the porous burner cone 4 is the combustion air flow zone (b) through which flows a mixture of the air blown through the air blowing cylinder 2, the primary gasiform fuel gasified on the burner cup 6, and fuel droplets floating in the air flow. This mixture is a very lean mixture containing fuel below the lower limit of combustion (namely an air-fuel mixture containing an excessive amount of air). Therefore flaming is prevented in the combustion air flow zone (b).

The flow of the combustion air and the mixture of gasified fuel and deficient air (oxygen) is accelerated as the flow passes through the restricted section 47 defined by the outlet of the porous burner cone 4 and the burner cup 6. Accordingly the combustion air and the gasified fuel are mixed well, and oxygen diffuses satisfactorily. Since the forms and dimensions of the components are decided so that the flowing speed of the air-fuel mixture balances the flaming speed, flaming is prevented in the mixing zone, and the air-fuel mixture ignites at the brim and the small holes 5 of the burner cup 6. The dimensions of the air blowing cylinder 2, the porous burner cone 4, and the burner cup 6 are decided so as to meet an inequality: the area of the restricted section/{the sectional area of the air outlet+(the sectional area of the cylindrical section 4a of the porous burner cone 4−the sectional area of the air blowing cylinder 2)}>1, to make the flowing speed of the air-fuel mixture balance the flaming speed. That is, the desirable sectional area of the restricted section is greater than 0.00154 $m^2$. The desirable sectional area of the restricted section to prevent flash back is smaller than 0.00667 $m^2$. Consequently, the sum of the total area in the small holes 5 of the burner cup 6 and the sectional area of the restricted section 47 is desirably more than 0.00154 and less than 0.00667 $m^2$.

Part of the high-temperature combustion gas circulates through the concave space formed by the front surface of the burner cup 6 and serves as a source for igniting the air-fuel mixture flowing out from the outlet of the porous burner cone 4. Consequently, blue flames blaze forth from the brim and the small holes 5 of the burner cup 6.

The burner cup 6 functions to provide a source of ignition with its concave space and to divide the space in the burner A exactly into the zones without disturbing the flow of the combustion air. Therefore, an appropriate number of the small holes 5 are formed in parallel to the longitudinal center axis of the burner cup 6 around the central portion and along a circle near the brim of the burner cup 6.

Part of the air-fuel mixture that did not ignite at the brim of the burner cup 6 flows along the inner and outer peripheries of the annular flame holding ring 7 and ignites at the front cavity of the annular flame holding ring 7. The high-temperature combustion gas circulates through the cavity of the annular flame holding ring 7 and ignites the air-fuel mixture that was not ignited at the burner cup 6. Consequently, stable blue annular flames blaze around the brim of the flame holding ring 7.

Part of the high-temperature combustion gas is sucked through the combustion gas inlet 46 into the porous burner cone 4 and, as mentioned above, heats the porous burner cone 4 and gasifies the fuel droplets.

When the high-temperature combustion gas produced by blue flame combustion at the burner cup 6 and the annular flame holding ring 7 circulates and flows into the porous burner cone 4, the high-temperature combustion gas flows along the outer surface and the inner surface of the porous burner cone 4 to transfer heat to the porous burner cone 4 both from the outside and from the inside. This reduces burner starting time and supplies sufficient heat for gasifying the fuel to the porous burner cone 4.

In the full-capacity operation of the burner A, for instance, the maximum heat demand for gasifying the liquid fuel is approximately 1,000 cal/hr. This heat demand is only approximately 7% of the heat of the combustion gas sucked into the porous burner cone 4 at approximately the same flow rate as that of the combustion air. Thus the heat supply to the porous burner cone 4 by means of the circulating combustion gas improves the efficiency of the burner remarkably.

As described hereinbefore, according to the present invention, complete blue flame combustion is achieved, and the liquid fuel is mixed with the combustion air after being gasified. Therefore, the fuel is mixed satisfactorily with the combustion air, and soot and carbon monoxide are not produced even if the excess air ratio is reduced.

Figure 5:
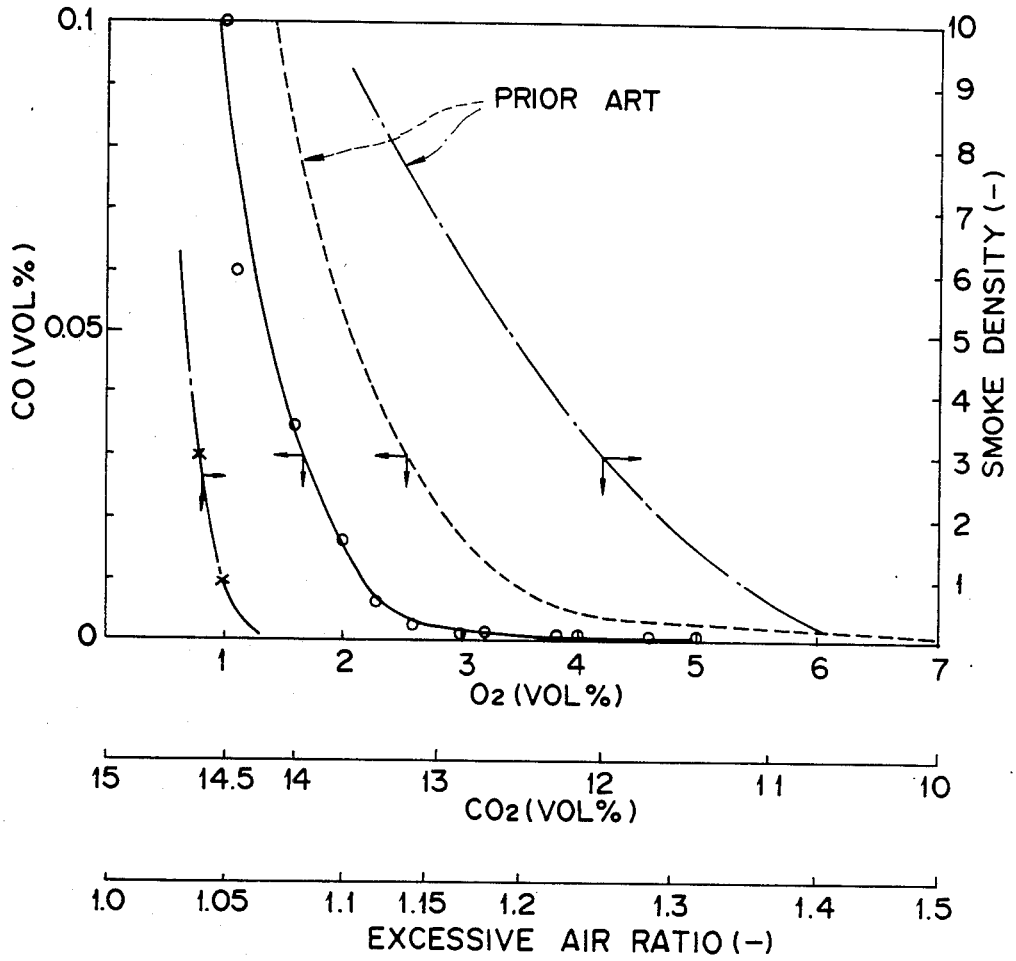
FIG. 5 is a graph showing, in comparison between the burner of the present invention and the conventional burner, the production of carbon monoxide and soot.

The mode of production of soot and carbon monoxide with a household hot water supplying apparatus B equipped with a burner according to the present invention is shown in FIG. 5.

Since a general standard of CO discharge amount is $CO/CO_2 \leqq 0.02$, the concentration of oxygen in the air-fuel mixture desirably is 1% by volume or above. From the viewpoint of reducing smoke density, the desirable concentration of oxygen is 1.5% by volume or above.

According to the method of combustion of the present invention, the oxygen concentration of the air-fuel mixture in the vicinity of the wall surface of the porous burner cone 4 is less than the lower limit of combustion to prevent flaming within the porous burner cone 4. After the burner A embodying the present invention has been operated for 1,500 hours, neither soot nor tar was produced over the ceramic surface of the porous burner cone 4.

The present invention was originated with a knowledge that the principal cause of combustion noise is the principal impulsive air flow over the surface of the flame holding plate. According to the present invention, the flame holding member is disposed after the outlet of the porous burner cone 4 away from the fuel spraying nozzle 1. Consequently, flames blaze in an open space, and hence the combustion noise diminishes.

The measured noise level of the hot water supplying apparatus B equipped with the burner A was 40 to 43 dB (A) and 65 to 70 db (c).

Furthermore, the use of the porous burner cone 4 and the burner cup 6 (each of which is a member made of a ceramic of 20 to 50% porosity produced by molding a kneaded paste containing 30 to 75% by weight silicon, 10 to 50% by weight clay, and the balance silicon nitride and firing the molding at a temperature of 1350° to 1650° C.) contributes greatly to the achievement of perfect blue flame combustion and to the prevention of the production of soot.

Oxygen needs to be diffused into evaporated and gasified fuel to achieve perfect blue flame combustion. According to the method of the present invention, approximately 60% of the amount in weight of the fuel droplets sprayed by the fuel spraying nozzle 1 reaches the inner surface of the conical section **4*b* of the porous burner cone 4 and the surface of the burner cup 6. Since the porous burner cone 4 and the burner cup 6 are formed of an absorptive porous ceramic, the fuel droplets which have reached the surfaces of the porous burner cone 4 and the burner cup 6 are absorbed into and held by the ceramic walls temporarily and are gasified immediately by the heat of the porous burner cone 4** heated by the combustion gas.

The fuel gasifying capacity of the porous burner cone 4 and the burner cup 6 is greatly dependent on the fuel absorbing capacity of the constituent ceramic. The fuel absorbing capacity, in turn, is dependent on the porosity. Test porous burner cones of various materials were manufactured and subjected to test combustion to examine the properties and performance during combustion. The results of the test combustion are tabulated below.

| | Porosity (%) | Coef. of thermal expansion (×10) | Heat shock resistance | Blue flame forming ability |
|---|---|---|---|---|
| Porcelain | 0 | 6.5 | X | X |
| Alumina | 0 | 8.0 | X | X |
| | 40 | 8.0 | X | |
| Cordierite | 25 | 4.0 | Δ | Δ |
| Silicon nitride | 30 | 3.0 | | |

As is apparent from the results, when the porosity is small, blue flame burning is impossible. Considering heat shock resistance, silicon nitride is the best material for the porous burner cone 4 and the burner cup 6. However, the burner cup 6 may be made of a metal, such as a stainless steel, of excellent heat resistance.

Figure 6:
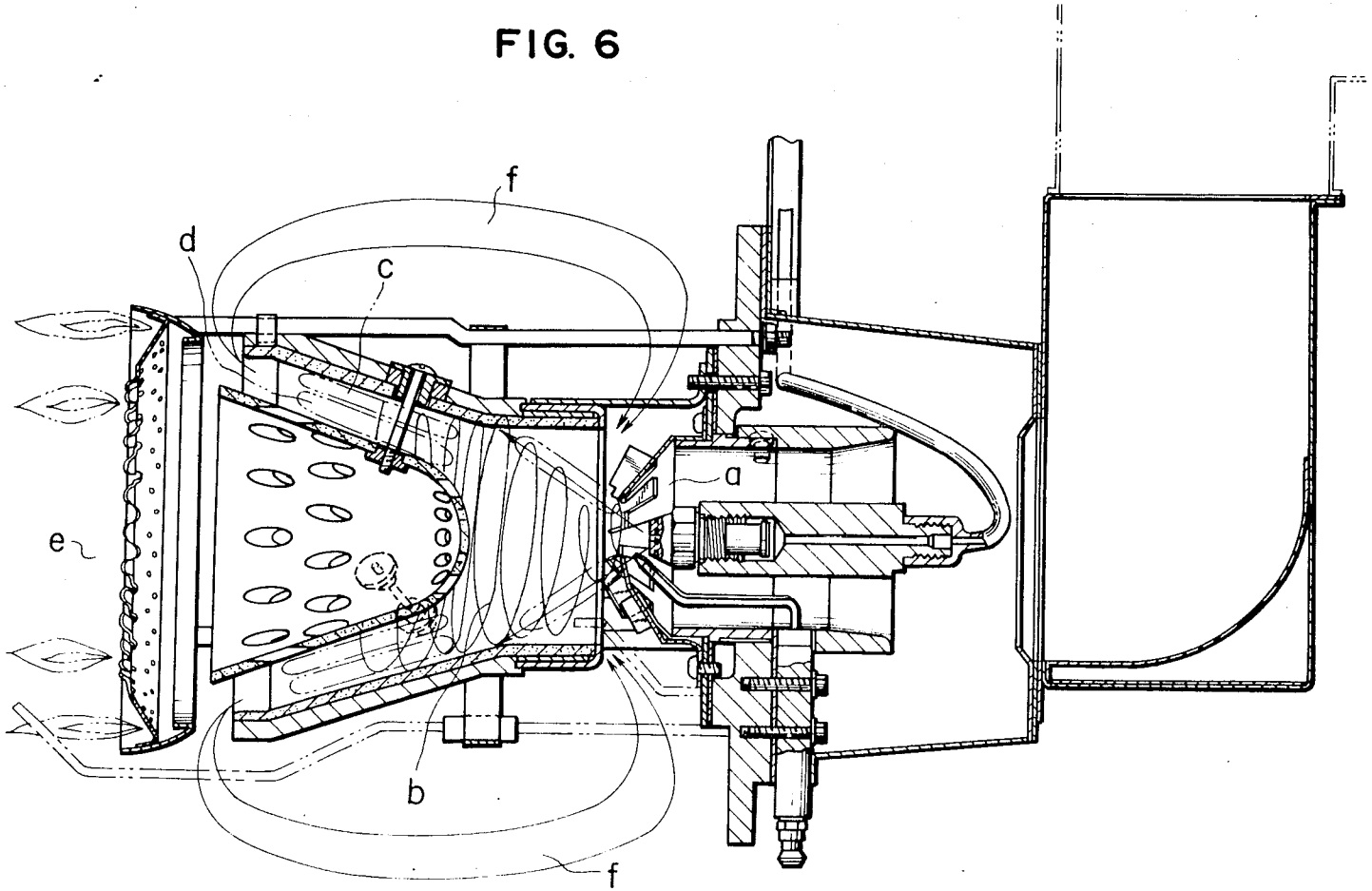
FIG. 6 is a schematic sectional view of a burner, in a second embodiment, according to the present invention.
Figure 7:
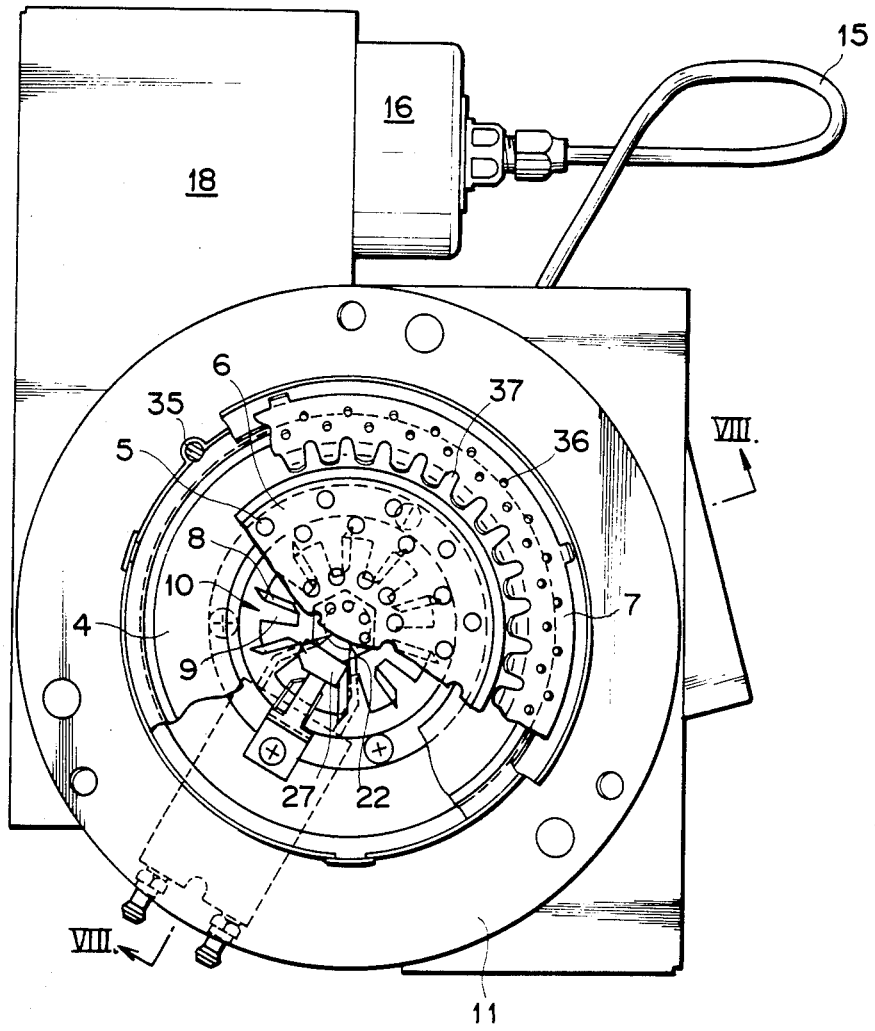
FIG. 7 is a front elevation partly broken of a burner, in a third embodiment, according to the present invention.

The second principle of the present invention will be described hereinafter. The second principle employs the first principle as the basic principle. According to the second principle, the air blown through the air blowing cylinder 2 is whirled. A burner embodying the second principle will be described hereunder in connection with FIGS. 6–8. The current of air blown through the air blowing cylinder 2 is converted into a spiral air flow by means of the vanes 8 of an air whirling plate 10 having a convergent flow forming part 9. The spiral air flow is guided by the convergent flow forming part 9 of the air whirling plate 10 so as to be a convergent spiral flow. Thus the whirling combustion flows through the combustion air flow zone (b). The fuel sprayed by the fuel spraying nozzle contacts the porous burner cone 4 and the burner cup 6 and is gasified by the heat of the porous burner cone 4 and the burner cup 6 and the heat of the high-temperature combustion gas sucked from the high-temperature combustion gas circulating zone (f) through the combustion gas inlet 46 of the porous burner cone 4 into the interior space of the porous burner cone 4. The gasified fuel is stirred by and mixed with the whirling combustion air. The air-fuel mixture thus formed flows through the fuel gasifying zone (c) and the mixing zone (d) at the outlet of the porous burner cone 4. Although the gasified fuel is mixed with the combustion air within the porous burner cone 4, the air-fuel mixture does not flame within the porous burner cone 4 because the burner cup 6 is formed and disposed relative to the porous burner cone 4 so that the flow speed of the air-fuel mixture through the space between the porous burner cone 4 and the burner cup 6 is higher than the flaming speed. Therefore, the air-fuel mixture does not flame within the porous burner cone 4, and blue flame combustion occurs in the combustion zone (e).

A hot water supplying apparatus B equipped with a burner embodying the present invention will be described hereinafter.

The capacity of the burner A is 35,000 kcal/hr. The burner A is mounted on a flange 11 for mounting a heat exchanger provided on the wall of the combustion chamber 45 and inserted into the combustion chamber 45. The burner A comprises the fuel spraying nozzle 1, the air blowing cylinder 2 disposed so as to surround the fuel spraying nozzle 1, the porous burner cone 4 formed so as to enclose a fuel spraying zone into which the fuel spraying nozzle 1 sprays the fuel, the burner cup 6 disposed at the outlet of the porous burner cone 4, and the annular flame holding ring 7 disposed after the burner cup 6.

The air blowing cylinder 2 is a bottomless cylinder disposed coaxially with the fuel spraying nozzle 1 so as to blow air into the combustion chamber 45. The rear end of the air blowing cylinder 2 is connected to a duct 14' of a blower 43 at the outside of the combustion chamber 45. The fuel spraying nozzle 1 is held by the nozzle holder 13 extending coaxially with the air blowing cylinder 2. The fuel spraying nozzle 2 is disposed near the front end of the air blowing cylinder 2 in alignment with the longitudinal center axis of the porous burner cone 4.

The air blowing cylinder 2 is 40 mm in inside diameter and 55 mm in total length. The porous burner cone 4 consists of the cylindrical section **4*a* of 63 mm inside diameter and the conical section 4*b* having an expanded outlet end of 104 mm inside diameter. The total length of the porous burner cone 4 is 100 mm, and the cone angle of the conical section 4*b* is 30°. The distance between the rear end of the porous burner cone 4 and the front end of the air blowing cylinder 2 is 20 mm. The burner cup 6 is 90 mm in outside diameter and 45 mm in length. The distance between the rear end of the burner cup 6 and the front end of the air blowing cylinder 2 is 82 mm. The distance between the front end of the porous burner cone 4 and the front end of the burner cup 6 is 7 mm. The burner cup 6 is provided with 36 small holes 5 of 6 mm diameter. The annular flame holding ring 7 is 130 mm in outside diameter, 104 mm in inside diameter, and 15 mm in length. The distance between the front end of the porous burner cone 4 and the rear end of the annular flame holding ring 7 is 12 mm. The diameter of the nozzle holder 13** is 21 mm.

The blower 43 supplies air through the duct 14 to the air blowing cylinder 2 so that air is blown through the air blowing cylinder 2 at a flow rate of 0.5 to 1.3 $Nm^3$/min and at a flowing speed of 10 to 19 m/sec. In this embodiment, the flow rate is 0.8 $Nm^3$/min, and the flow speed is 16 m/sec.

The fuel spraying nozzle 1 is of well-known construction having a spraying angle of 60°. The rear end of the fuel spraying nozzle 1 is connected through a fuel supply tube 15 connected to the rear end of the nozzle holder 13 to a fuel supply source 44. An electromagnetic pump 16 is provided in the fuel supply tube 15. The capacity of the electromagnetic pump 16 in this embodiment is 4.3 l/hr. The capacity of the electromagnetic pump 16 needs to be 2.6 to 7.0 l/hr.

As illustrated, the porous burner cone 4 has a straight or slightly tapered cylindrical section **4*a* and a conical section 4*b* merging into the cylindrical section 4*a* at the rear end thereof and expanding toward the front. The porous burner cone 4 is held by a suitable holding cylinder 38 and disposed in front of the air blowing cylinder 2 with a gap 3 therebetween and coaxially with the fuel spraying nozzle 1**.

The dimensional and positional conditions for the porous burner cone 4 are: (the inside diameter of the cylindrical section **4*a*)>48 mm; (the inside diameter of the cylindrical section 4*a*)/(the inside diameter of the air blowing cylinder 2)>1.3; (the sectional area of the air passage of the air blowing cylinder 2)/{(the sectional area of the cylindrical section 4*a*)−(the sectional area of the air blowing cylinder 2)}>1; and (the sectional area of the cylindrical section 4*a*)−(the sectional area of the air blowing cylinder 2)>0.00077 $m^2$. In this embodiment, the inside diameter of the cylindrical section 4*a* is 63 mm and (the sectional area of the cylindrical section 4*a*)−(the sectional area of the air blowing cylinder 2**)=0.00173 $m^2$.

The gap 3 between the rear end of the porous burner cone 4 and the front end of the air blowing cylinder 2 is provided to form the combustion gas inlet 46 for sucking the high-temperature combustion gas from the combustion chamber 45 into the interior space of the porous burner cone 4 by the agency of a negative pressure generated in the vicinity of the gap 3 by the high-speed flow of the air blown through the air blowing cylinder 2. The burner cup 6 has a conical or semispherical form with an open bottom. The burner cup 6 is disposed coaxially with the porous burner cone 4 with the large part thereof received in the porous burner cone 4. The outer periphery of the burner cup 6 and the inner surface of the porous burner cone 4 define the annular restricted section 47.

The dimensions, forms, and positions of the porous burner cone 4 and the burner cup 6 are designed to meet the following conditions: (the cross sectional area of the annular restricted section 47 at the front end of the porous burner cone 4)/{the sectional area of the air passage of the air blowing cylinder 2+(the sectional area of the cylindrical section **4*a* of the porous burner cone 4−the sectional area of the air blowing cylinder 2)}>1 and 0.00154 $m^2$>the cross-sectional area of the annular restricted section 47 at the front end of the porous burner cone 4<0.00667 $m^2$. The range of the cross-sectional area is decided to prevent flash back at the outlet of the porous burner cone 4. In this embodiment, the cross-sectional area including the total area of the sectional areas of the 36 small holes 5 formed in the burner cup 6 is 0.00410 $m^2$. The number and the diameter of the small holes 5 may be increased or decreased to some extent as long as the condition for the cross sectional area of the annular restricted section 47 at the outlet of the porous burner cone 4** is satisfied.

The porous burner cone 4 and the burner cup 6 are made of a ceramic containing 42% by weight silicon, 18% by weight silicon nitride, and 40% by weight clay. The porous burner cone 4 and the burner cup 6 are manufactured by the following process.

A mixture of silicon powder, silicon nitride powder, and ethanol is ground by a cylinder mill for four hours. Water cannot be used instead of ethanol, because if a mixture of silicon powder, silicon nitride powder, and water is ground, the silicon and the silicon nitride react with the water and gas is produced.

After grinding the mixture, the ethanol is distilled out. To stabilize the powdery mixture against water, the powdery mixture is calcined at a temperature of 175° C. Then, the powdery mixture and a defloculant (polyacrylic soda) are added to a slurry of clay and water. The mixture is stirred for mixing to prepare a molding slurry. Then, the molding slurry is poured into molds to form the moldings of the porous burner cone 4 and the burner cup 6. The small holes 5 are formed in the molding of the burner cup 6. After being dried, the moldings are fired at a temperature of 1450° C. in an atmosphere of nitrogen for fifteen hours. The physical properties of the porous burner cone 4 and the burner cup 6 employed in the present invention are: porosity: 30%; bending strength: 13.0 kg/$mm^2$ at 25° C. and 13.0 kg/$mm^2$ at 700° C.; composition (X-ray peak ratio): $\alpha Si_3N_4=1.0$, $\beta Si_3N_4=1.0$, $O'=2.3$, X phase=0.2.

The porosity is dependent on the defloculant content and the firing temperature. The appropriate range of the porosity for the porous burner cone 4 and the burner cup 6 is 20 to 50%. In this embodiment, the porosity of the porous burner cone 4 and the burner cup 6 is 30%.

The moldings of the porous burner cone 4 and the burner cup 6 may be made by rubber press molding, injection molding, or pressure molding. Rubber press molding is advantageous in molding speed. However, the edges of the moldings formed by rubber press molding need to be machined, and the molding equipment is expensive. Injection molding also is advantageous in molding speed. However, since the paste contains 40 to 50% by volume binder, the paste is expensive, long firing is necessary to remove the binder, antipollution devices are necessary, and the molding equipment is expensive.

Although the molding speed of pressure molding is not as high as those of the above-mentioned molding processes, pressure molding is able to form thin moldings of uniform wall thickness, the molding does not require either machining or the removal of the binder, and hence the molding is finished through a simple process after molding and the molding equipment is inexpensive. Thus pressure molding is the most suitable molding process for molding the porous burner cone 4 and the burner cup 6.

The annular flame holding ring 7 is an annular member made of a heat resistant metal and having a generally V- or U-shaped section. The annular flame holding ring 7 is disposed in front of the burner cup 6 with the narrow end thereof facing the burner cup 6. The annular flame holding ring 7 is 130 mm in outside diameter, 104 mm in inside diameter (the same as the outside diameter of the outlet end of the porous burner cone 4) and 15 mm in length. The distance between the rear end of the annular flame holding ring 7 and the front end of the burner cup 6 is 12 mm.

A pair of igniters 22 are disposed adjacently to the fuel spraying nozzle 1 at positions where they will not obstruct the flow of the air blown through the air blowing cylinder 2.

In starting the burner A, the blower 43 and the electromagnetic pump 16 are started, and the igniters 22 are energized to produce sparks. Then, the air-fuel mixture is ignited by the sparks, and orange flames blaze in the central portion of the porous burner cone 4. A negative pressure prevails around the combustion gas inlet 46 of the porous burner cone 4 due to the suction of the flow of the air blown through the air blowing cylinder 2. Consequently, circulating flows of gas are generated from the outlet of the porous burner cone 4 through the gap 3 between the inlet of the porous burner cone 4 and the air blowing cylinder 2 (namely, the combustion gas inlet 46 into the interior of the porous burner cone 4). After the air-fuel mixture has been ignited, the hot combustion gas is sucked into the porous burner cone 4 by the agency of the circulating flow, and the sprayed fuel is gasified in an instant. The gasified fuel and the circulating gas flow along the inner surface of the porous burner cone 4 and form a layer containing insufficient oxygen over the inner surface of the porous burner cone 4. The gasified fuel and the circulating gas flow into the restricted section 47 formed between the outlet of the porous burner cone 4 and the burner cup 6, where the gasified fuel is mixed with the combustion air flowing through the central portion of the porous burner cone 4 into the restricted section 47.

The orange flames blazing within the porous burner cone 4 move downstream with respect to the burner cup 6 as the combustion gas is sucked into the porous burner cone 4 and ignite the air-fuel mixture.

The fuel droplets which were sprayed by the fuel spraying nozzle 1 and have not yet been gasified by the circulating combustion gas impinge against the inner surface, particularly the inner surface of the conical section **4*b* of the porous burner cone 4. Since the porous burner cone 4 is made of a porous ceramic, the fuel droplets are absorbed temporarily by the wall of the porous burner cone 4, and then the absorbed fuel droplets are gasified in an instant by the heat of the porous burner cone 4 heated by the circulating combustion gas. Then, the gasified fuel flows toward the outlet of the porous burner cone 4 and is mixed with the combustion air in the restricted section defined by the outlet end of the porous burner cone 4 and the periphery of the burner cup 6**.

The high-temperature combustion gas flows through the front cavity of the burner cup 6 and serves as a heat source for igniting the mixture of the combustion gas and the gasified fuel flowing out from the outlet of the porous burner cone 4. Blue flames blaze also from the small holes 5 formed in the burner cup 6.

Made of a porous ceramic similarly to the porous burner cone 4, the burner cup 6 as well as the porous burner cone 4 functions as a fuel gasifying means in addition to functioning as means to guide the flow of the combustion air and to ignite the air-fuel mixture.

Part of the air-fuel mixture which has not been ignited at the brim of the burner cup 6 flows along the inner and outer surfaces of the annular flame holding ring 7 and is ignited in front of the annular flame holding ring 7. As in the front cavity of the burner cup 6, the high-temperature combustion gas circulates in the space defined by the annular flame holding ring 7. This circulating of high-temperature combustion gas serves as a heat source for igniting the air-fuel mixture which has not been ignited at the periphery of the burner cup 6. Accordingly, stable blue annular flames blaze around the periphery of the flame holding ring 7.

A third embodiment of the present invention will be described hereinafter in connection with FIGS. 7 to 10.

A burner A embodying the present invention comprises a fuel spraying nozzle 1, an air blowing cylinder 2 surrounding the fuel spraying nozzle 1, an air whirling plate 10 disposed in front of the air blowing cylinder 2, a porous burner cone 4 defining the fuel spraying zone of the fuel spraying nozzle 1, a burner cup 6 disposed in front of the porous burner cone 4 with the rear end portion thereof received in the porous burner cone 4, and a flame holding ring 7 disposed in front of the burner cup 6.

The air blowing cylinder 2 is a straight cylinder 12 penetrating through the central part of a mounting flange 11 attached to the flanged pipe, not shown, of the combustion chamber. The rear end of the air blowing cylinder 2 is connected through a duct 14 to a blower 43. The air whirling plate 10 is disposed in front of the air blowing cylinder 2.

A nozzle holder 13 holding the fuel spraying nozzle 1 is disposed coaxially within the air blowing cylinder 2. The center axis of the fuel spraying nozzle 1 is aligned with the longitudinal center axes of the porous burner cone 4 and the air blowing cylinder 2.

The fuel spraying nozzle 1 is a nozzle of well-known construction having a spraying angle of 60°. The fuel spraying nozzle 1 is connected through a duct 14' penetrating axially through the nozzle holder 13 and a fuel supply tube 15 to a fuel supply source. An electromagnetic pump 16 and a fuel strainer 17 are provided in the fuel supply tube 15. The electromagnetic pump 16 and the fuel strainer 17 are mounted on a mounting plate 18 attached to the backside of the mounting flange 11 as integral components of the burner A.

A member 19 of the duct 14' is fixed to the backside of the mounting plate 18 to interconnect the air blowing cylinder 2 and the blower 43 with the duct 14'. A recess 20 for inserting the fuel supply tube 15 and a recess 21 for inserting the igniters 22 are formed oppositely to each other in the front surface of the mounting plate 18 facing the mounting flange 11. The fuel supply tube 15 and the igniters 22 are inserted through the recesses 20 and 21, respectively.

A pair of the igniters 22 are disposed below the horizontal center line of the fuel spraying nozzle 1 symmetrically with respect to the vertical center line of the same at an angular interval of 120°. The free end of each igniter 22 extends upward near to the front of the fuel spraying nozzle 1.

Figure 9:
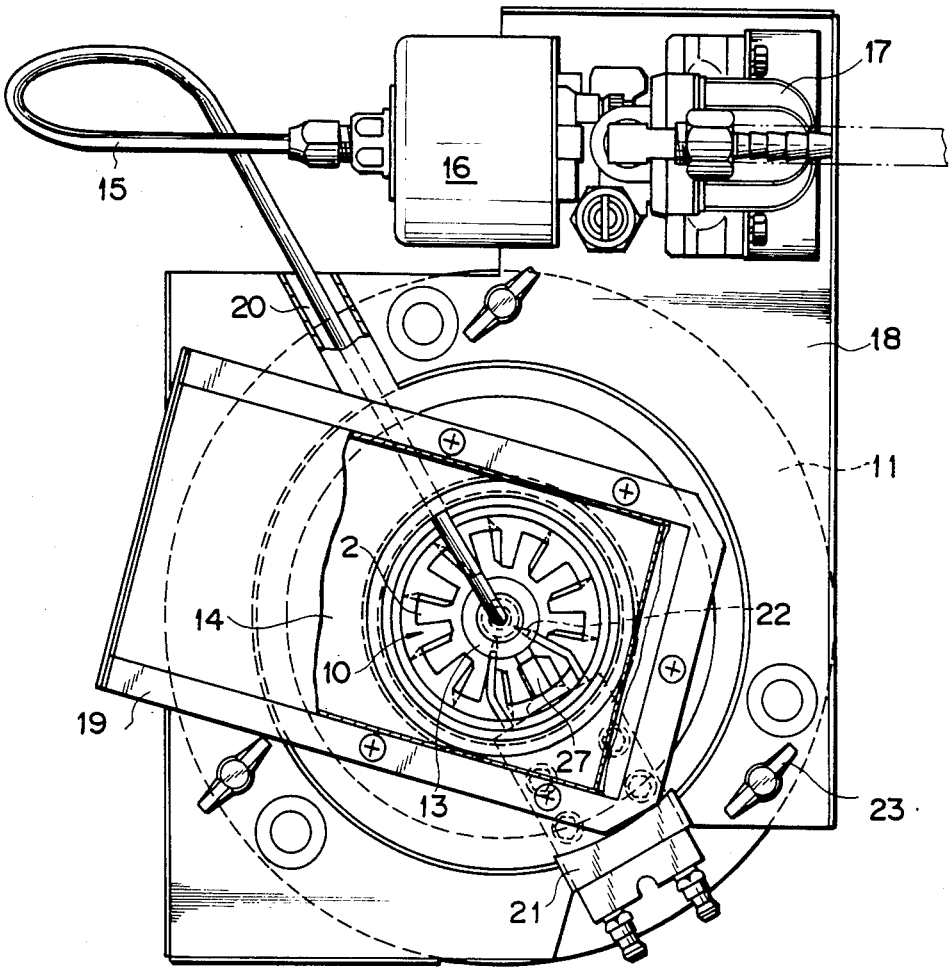
FIG. 9 is a rear view partly broken of the burner of FIG. 7.
Figure 10:
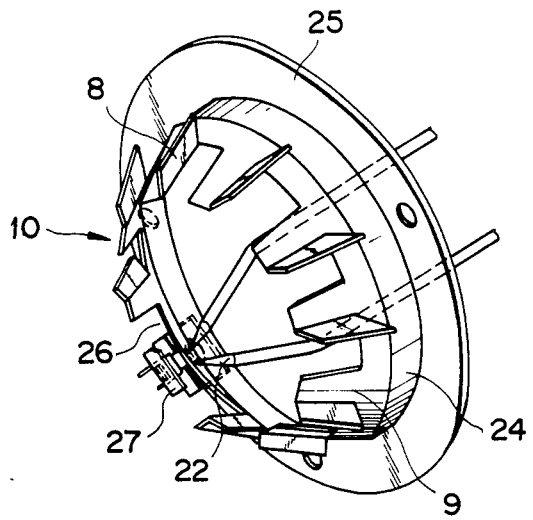
FIG. 10 is a perspective view of the air whirling plate of the burner of FIG. 7.

In FIG. 9, indicated at 23 are thumbscrews fixing the mounting plate 18 to the mounting flange 11.

The air whirling plate 10 consists of a convergent flow forming part 9 of a conical form tapering toward the front and a plurality of vanes 8 formed so as to extend at an angle to the center axis of the air whirling plate 10 by raising part of the wall of the convergent flow forming part 9 at equal angular intervals. In this embodiment, a cylindrical section 24 extends from the rear end of the convergent flow forming part 9 and a flange 25 is formed at the rear end of the cylindrical section 24. The cylindrical section 24 receives the front end of the air blowing cylinder 2 (the straight cylinder 12), and the flange 25 is screwed to the mounting flange 11 so that the air blowing cylinder 2 is covered with the air whirling plate 10.

Part of the vanes 8 and the convergent flow forming part 9 at an angular position of 120° from the upper vertical center line of the air whirling plate 10 are cut to form an opening 26. A firing plate 27 is disposed at the opening 26 (namely, in front of the igniters 22). The firing plate 27 extends along the outer surface of the air whirling plate 10 over the front end of the vanes 8. The front section of the firing plate 27 is tilted toward the front similarly to the convergent flow forming part 9 at a smaller inclination to the axis of the air whirling plate 10 than that of the convergent flow forming part 9 so that the air-fuel mixture is caused to circulate in front of the firing plate 27. This ensures ignition of air-fuel mixture.

As illustrated, the porous burner cone 4 consists of a straight or slightly tapered cylindrical section **4*a* and a conical section 4*b* tapering toward and merging into the cylindrical section 4*a*. The porous burner cone 4 is disposed coaxially with the fuel spraying nozzle 1 in front of the air whirling plate 10 so as to enclose the fuel spraying zone of the fuel spraying nozzle 1 and is held by a holding member 28 screwed to the mounting flange 11**.

A gap 3 is formed between the rear opening of the porous burner cone 4 and the air blowing cylinder 2. The gap 3 serves as a combustion gas inlet 46 for sucking the high-temperature combustion gas from the combustion chamber 45 into the interior of the porous burner cone 4 by the agency of a negative pressure produced in the gap 3 by the high-speed current of the air blown through the air blowing cylinder 2.

The burner cup 6 generally has the form of a hollow cone with an open bottom and is provided with a plurality of small holes 5 extending in parallel to the longitudinal center axis thereof in the wall thereof except the central circular area and the middle annular area. The burner cup 6 is disposed coaxially with the porous burner cone 4 with the majority of the convex wall thereof received in the porous burner cone 4. The outer periphery of the burner cup 6 and the inner periphery of the porous burner cone 4 define an annular restricted space 29. The dimensions and forms of the porous burner cone 4 and the burner cup 6 and the relative disposition between the porous burner cone 4 and the burner cup 6 are decided so that the change of the cross-sectional area of the annular restricted space 29 is small, so that stagnant flow of the air-fuel mixture containing the gasified fuel will not occur within the porous burner cone 4. The cross-sectional area of the annular restricted space 29 is diminished gradually so that the flow speed of the air-fuel mixture in the annular restricted space 29 is higher than the flaming speed. Accordingly, the burner cup 6 is formed in the form of a cone having an acute cone angle and a sufficient height so that the apex of the convex wall thereof lies nearer to the fuel spraying nozzle 1 than is the case with the conventional burner cup. From the viewpoint of preventing stagnant flow of the air-fuel mixture within the porous burner cone 4 and flash back, it is desirable that the apex of the burner cup 6 lies nearest to the fuel spraying nozzle 1. However, if the burner cup 6 is disposed excessively near to the fuel spraying nozzle 1, most of the fuel sprayed by the fuel spraying nozzle 1 impinges against the burner cup 6, and the fuel droplets gather and drip from the burner cup 6, which adversely affects the gasifying efficiency. Therefore, the cone angle and the height of the burner cup 6 need to be decided so as to meet the above-mentioned requirements and to obviate the reduction of fuel gasifying efficiency.

The porous burner cone 4 and the burner cup 6 are fixedly joined together with a suitable gap therebetween by means of a plurality of bolts 30 and nuts 34. Each bolt 30 has a threaded portion 30*a* of a suitable thread length and a body 30*b* (unthreaded portion) that is a round and smooth rod of 3 mm or less diameter. The outside diameter of the threaded portion 30*a* is slightly greater than that of the body 30*b*.

The bolts 30 are inserted from the outside of the porous burner cone 4 through bolt holes 31 and 32 formed in a holding cylinder 38 and the porous burner cone 4, a cone fixing sleeve 33, and a hole 39 formed in the burner cup 6 until the threaded portion 30*a* projects from the hole 39. The nut 34 is screwed on the threaded portion 30*a*. The cone fixing sleeve 33 and the nut 34 have flanges 33*a* and 34*a* respectively. The porous burner cone 4 and the burner cup 6 are held between the flanges 33*a* and 34*a*. Three bolt holes 32 and three holes 39 are formed at equal angular intervals in the porous burner cone 4 and the burner cup 6 respectively. Accordingly, the porous burner cone 4 and the burner cup 6 are connected fixedly and coaxially with the annular restricted space 29 therebetween by the bolts 30 and the nuts 34. The burner cup 6 is held securely by the balanced tensions of the bolts 30.

The diameter of the bolt hole 31 formed in the holding cylinder 38 is approximately same as the outside diameter of the flange 33*a* of the cone fixing sleeve 33, and a heat expansion ceramic sleeve 40 is fitted in each bolt hole 31. When the burner A is operated, the heat expansion ceramic sleeves 40 are heated, and thereby the heat expansion ceramic sleeves expands in thickness, so that the bolts 30 and the nuts 34 engage firmly and securely. Since the outer periphery, the inner periphery and upper surface, and the bottom surface of heat expansion ceramic sleeves 40 are covered by the holding cylinder 38, the cone fixing sleeve 33, and the porous burner cone 4, respectively, only a small portion of each is exposed, and the heat expansion ceramic sleeves 40 are not subject to erosion by the combustion gas. Such a conformation of the bolts 30 and the nuts 34 prevents the stagnation of the air-fuel mixture behind the bolts 30, and hence flaming within the porous burner cone 4 is obviated.

The annular flame holding ring 7 is disposed coaxially with and in front of the burner cup 6 and is welded to supporting rods 35 extending from the mounting flange 11. The annular flame holding ring 7 consists of an annular wall 7*a*, a rear brim 7*b* extending inward and frontward from the rear edge of the annular wall 7*a*, and a front brim 7*c* extending from the middle part of the annular wall 7*a* inward and frontward at an angle smaller than that of the rear brim 7*b* and having a length longer than that of the rear brim 7*b*. The front brim 7*c* is provided with a plurality of small holes 36 in the annular wall 7*a* and a plurality of recesses 37 along the edge thereof.

The holding cylinder 38 covering the porous burner cone 4 is made of ceramic fibers. The heat expansion ceramic sleeves 40 are fitted in the holes 39. When heated, the heat expansion ceramic sleeves expand to hold the corresponding bolt 30 firmly.

Figure 8:
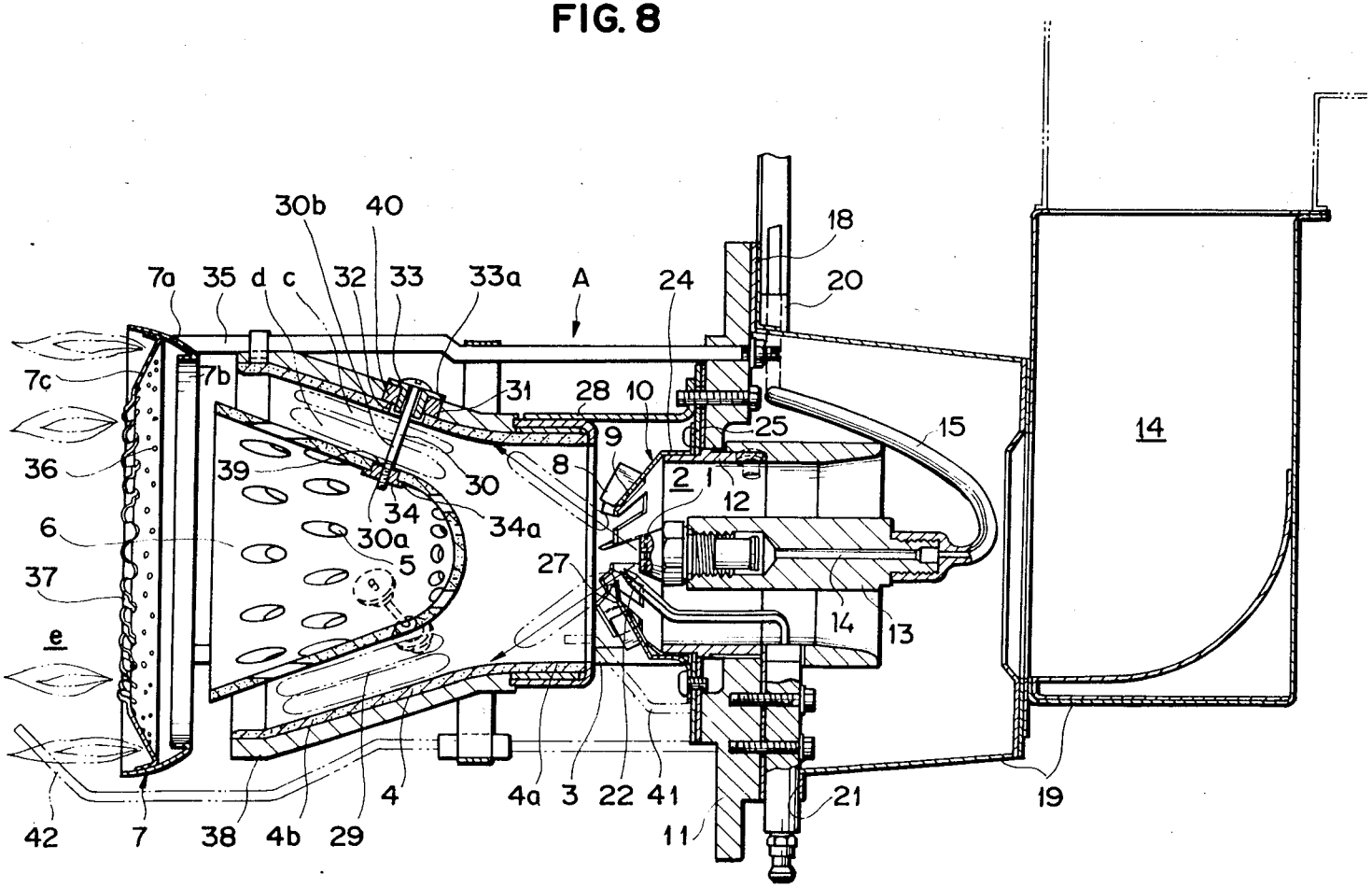
FIG. 8 is a sectional view taken on line VIII—VIII of FIG. 7.

In FIG. 8, indicated at 41 is a red flame detector and at 42 is a flame rod.

To start the burner A, the blower 43 and the electromagnetic pump 16 are actuated, and the igniters 22 are energized. Then, the air-fuel mixture stagnating behind the firing plate 27 disposed in front of the igniters 22 is ignited by sparks produced by the igniters 22. Then, the flaming air-fuel mixture thus ignited is carried downward by the air blown through the air blowing cylinder 2 and ignites the fuel droplets flowing down along the wall of the porous burner cone 4 without being gasified in the initial stage of combustion, so that orange flames expand within the porous burner cone 4 along the dripping flows of the fuel droplets. This ensures ignition of the fuel droplets before they drip down to the bottom of the porous burner cone 4.

The air blown through the air blowing cylinder 2 flows is caused to flow in a whirling convergent flow by the agency of the vanes 8 and the convergent flow forming part 9 of the air whirling plate 10. This convergent air flow produces a negative pressure in the vicinity of the inlet of the porous burner cone 4, and thereby the high-temperature combustion gas is sucked into the porous burner cone 4. Consequently, a circulating gas flow is produced from the outlet of the porous burner cone 4 through the space between the inlet of the porous burner cone 4 and the air blowing cylinder 2 (namely, the combustion gas inlet) into the interior space of the porous burner cone 4. After the air-fuel mixture has been ignited, this circulating gas flow causes the high-temperature combustion gas to flow into the porous burner cone 4, and thereby the sprayed fuel droplets are gasified instantly by the heat of the circulated combustion gas. The gasified fuel mixes with the circulated combustion gas and forms a layer of an air-fuel mixture containing insufficient oxygen over the inner surface of the porous burner cone 4.

The fuel droplets sprayed by the fuel spraying nozzle 1 and not gasified by the combustion gas impinge against the inner surface of the porous burner cone 4 (particularly against the inner surface of the conical section 4*b* of the porous burner cone 4) and are absorbed temporarily by the porous ceramic wall of the porous burner cone 4. The fuel thus absorbed is evaporated and gasified in an instant, because the porous burner cone 4 is heated to a high temperature by the combustion gas. Consequently, a fuel gasifying zone (c) is formed within the porous burner cone 4. The whirling combustion air flows inside the fuel gasifying zone (c) and mixes well with the gasified fuel flowing in the fuel gasifying zone (c) to produce an air-fuel mixture containing sufficient oxygen. This air-fuel mixture flows through the outlet of the porous burner cone 4. This a mixing zone (d) is formed behind the fuel gasifying zone (c). The whirling flow of the combustion gas forms uniform flow of the air-fuel mixture through the outlet of the porous burner cone 4.

The orange flames blazing within the porous burner cone 4 move over the burner cup 6 as the combustion gas is sucked into the porous burner cone 4. The air-fuel mixture is ignited and burns in blue flames in the front of the burner cup 6.

The combustion gas stagnates in the front cavity of the burner cup 6 and serves as a heat source for igniting the air-fuel mixture flowing through the outlet of the porous burner cone 4.

Forming the burner cup 6 from a porous ceramic material similarly to the porous burner cone 4 enables the burner cup 6 to function as a means to gasify the fuel in addition to functioning as a means to adjust the flow of the gas and to ignite the air-fuel mixture. However, if desired, the burner cup 6 may be made of a metallic plate having a plurality of small holes.

Part of the air-fuel mixture which was not ignited in the front of the burner cup 6 flows along the inner and outer surfaces of the annular annular flame holding ring 7 and is ignited in the front cavity of the flame holding ring 7. The combustion gas stagnates also in the front cavity of the annular flame holding ring 7 as in the front cavity of the burner cup 6 and ignites the air-fuel mixture which has not been ignited at the burner cup 6. Accordingly, stable blue flames blaze at the end and in the small holes 36. Thus a combustion zone (e) is formed around the annular flame holding ring 7.

Thus in an apparatus for gasifying and combusting a liquid fuel, in a first embodiment, according to the present invention, the nozzle zone, the combustion air zone, the fuel gasifying zone, the mixing zone, the combustion zone, and the high-temperature combustion gas circulating zone are formed separately, which improves the effects of blue flame combustion.

In an apparatus for gasifying and combusting a liquid fuel, in a second embodiment, according to the present invention, (1) an air whirling plate having a plurality of vanes skewed and declined toward the front with respect to the longitudinal axis of the air whirling plate and a convergent flow forming part is disposed in front of an air blowing cylinder; and, therefore the air blown through the air blowing cylinder flow; in a convergent whirling flow, and thereby the mixing of the air and the gasified fuel is accelerated, and the combustion gas is sucked through the combustion gas inlet into the porous burner cone; and (2) the cone angle and the disposition relative to the porous burner cone of the burner cup are decided so that the cross-sectional area of the space between the porous burner cone and the burner cup does not change greatly; the air-fuel mixture does not stagnate within the porous burner cone, and the flow speed of the air-fuel mixture in the space between the porous burner cone and the burner cup is greater than the flaming speed; and therefore the air-fuel mixture does not flame within the porous burner cone in spite of the mixing of the gasified fuel and the air within the porous burner cone.

An apparatus for gasifying and combusting a liquid fuel, in a third embodiment, according to the present invention is constituted by integrating the components and the constitution of the first and second embodiments for the practical application of the invention.

We claim:

1. Apparatus for gasifying and combusting a liquid fuel so as to obtain at least predominantly blue flames, said apparatus comprising:

(a) a fuel spraying nozzle adapted to emit a conical spray of fuel defined by a first apex angle;

(b) an air blowing cylinder disposed coaxially with and so as to surround said fuel spraying nozzle;

(c) a porous burner cone disposed coaxially with and downstream of said fuel spraying nozzle, said porous burner cone comprising an at least generally cylindrical section and an at least generally conical section connected to said at least generally cylindrical section and flaring in the downstream direction at a second apex angle less than the first apex angle;

(d) said porous burner cone being sized, shaped, and positioned so as to surround the zone into which said fuel spraying nozzle sprays droplets of liquid fuel;

(e) said porous burner cone and said air blowing cylinder being spaced from one another to form a combustion gas suction inlet between the upstream end of said at least generally cylindrical section of said porous burner cone and the downstream end of said air blowing cylinder;

(f) said porous burner cone being made of an absorptive porous ceramic;

(g) a porous burner cup disposed coaxially with said porous burner cone;

(h) said porous burner cup being nested in said at least generally conical section of said porous burner cone;

(i) said porous burner cup having the form of a hollow cone with a bottom opened in the downstream direction;

(j) said porous burner cup having a plurality of small holes through the wall thereof except at the central portion around the apex thereof; and (k) a flame holding ring disposed coaxially with and downstream of said porous burner cup.

2. Apparatus as recited in claim 1 and further comprising an air whirling plate disposed coaxially with and downstream of said air blowing cylinder and upstream of said porous burner cone, said air whirling plate comprising:

(a) vanes sized, shaped, and positioned to cause whirling flow of the combustion air as it exits said air blowing cylinder and (b) a convergent flow forming part sized, shaped, and positioned to cause the flow of the combustion air to converge inwardly as it exits said air flowing cylinder.

3. A method of combusting a liquid fuel in a burner comprising:

(a) a fuel spraying nozzle adapted to emit a conical spray of fuel defined by a first apex angle;

(b) an air blowing cylinder disposed coaxially with and so as to surround said fuel spraying nozzle;

(c) a porous burner cone disposed coaxially with and downstream of said fuel spraying nozzle, said porous burner cone comprising an at least generally cylindrical section and an at least generally conical section connected to said at least generally cylindrical section and flaring in the downstream direction at a second apex angle less than the first apex angle;

(d) said porous burner cone being sized, shaped, and positioned so as to surround the zone into which said fuel spraying nozzle sprays droplets of liquid fuel;

(e) said porous burner cone and said air blowing cylinder being spaced from one another to form a combustion gas suction inlet between the upstream end of said at least generally cylindrical section of said porous burner cone and the downstream end of said air blowing cylinder;

(f) a porous burner cup disposed coaxially with said porous burner cone;

(g) said porous burner cup being nested in said at least generally conical section of said porous burner cone;

(h) said porous burner cup having the form of a hollow cone with a bottom opened in the downstream direction;

(i) said porous burner cup having a plurality of small holes through the wall thereof except at the central portion around the apex thereof; and (j) a flame holding ring disposed coaxially with and downstream of said porous burner cup, said method comprising the steps of:

(k) injecting a liquid fuel from said fuel spraying nozzle so that most of the fuel droplets sprayed by said fuel spraying nozzle impinge against and are gasified by said porous burner cone or said porous burner cup, thereby producing a primary fuel gas;

(l) mixing the fuel gasified by said porous burner cone with high-temperature combustion gas;

(m) mixing part of the fuel droplets that do not impinge against said porous burner cone or said porous burner cup with high-temperature combustion gas, thereby producing a secondary fuel gas;

(n) mixing the rest of the fuel droplets that do not impinge against said porous burner cone or said porous burner cup with combustion air to produce an air-fuel mixture;

((o) guiding the primary fuel gas, the secondary fuel gas, the air-fuel mixture, and additional combustion air to a mixing zone downstream of said burner cone and upstream of said flame holding ring;

(p) mixing the primary fuel gas, the secondary fuel gas, the air-fuel mixture, and the additional combustion air in said mixing zone to produce a combustible air-fuel mixture; and (q) combusting the combustible air-fuel mixture in a combustion zone downstream of said flame holding ring to produce blue flames.

4. The method recited in claim 3 wherein the combustion air flows into said mixing zone in a whirling flow.

* * * * *